United States Patent [19]

Perkins et al.

[11] 4,130,775

[45] Dec. 19, 1978

[54] CHARGE IMAGE CHARGE TRANSFER CATHODE RAY TUBE HAVING A SCAN EXPANSION ELECTRON LENS SYSTEM AND COLLIMATION ELECTRODE MEANS

[75] Inventors: Peter E. Perkins, Tigard; Stephen F. Blazo, Portland, both of Oreg.

[73] Assignee: Tektronix, Inc., Beaverton, Oreg.

[21] Appl. No.: 760,053

[22] Filed: Jan. 17, 1977

[51] Int. Cl.[2] ..... H01J 31/58; H01J 29/56

[52] U.S. Cl. ..... 313/397; 313/437

[58] Field of Search ..... 313/397, 458, 460, 437, 313/421, 426, 449

[56] References Cited

U.S. PATENT DOCUMENTS

| | | | |
|---|---|---|---|
| Re. 28,223 | 11/1974 | Odenthal et al. | 313/460 X |
| 2,520,813 | 8/1950 | Rudenberg | 313/460 X |
| 3,207,936 | 9/1965 | Wilbanks et al. | 313/421 |
| 3,293,473 | 12/1966 | Anderson | 313/398 |
| 3,376,449 | 4/1968 | Harrison | 313/460 |
| 3,496,406 | 2/1970 | Deschamps | 313/429 X |
| 3,497,763 | 2/1970 | Hasker | 313/473 X |
| 3,710,170 | 1/1973 | Hayes et al. | 313/395 X |
| 3,710,173 | 1/1973 | Hutchins et al. | 313/395 X |
| 3,753,129 | 8/1973 | Janko | 315/8.5 X |
| 3,792,303 | 2/1974 | Albertin et al. | 313/429 X |
| 3,798,477 | 3/1974 | Soltys | 313/392 |
| 3,887,834 | 6/1975 | Himmelbauer | 313/437 X |

*Primary Examiner*—Robert Segal
*Attorney, Agent, or Firm*—Adrian J. La Rue

[57] ABSTRACT

A cathode ray tube includes first and second electrostatic quadrupole lens between the electron gun and the vertical deflection plates to properly focus the electron beam before it enters the vertical deflection plates. A third electrostatic quadrupole lens is located between the vertical deflection plates and the horizontal deflection plates to enhance the angle of deflection as well as to aid in the proper focus of the electron beam as it moves from the vertical deflection plates into the horizontal deflection plates thereby providing substantially improved vertical sensitivity and scan expansion of the electron beam while maintaining the beam velocity constant. A collimation electrode means follows the horizontal deflection plates and flood gun means and is formed of conductive coatings having specific configurations disposed on the inner surface of the tube envelope thereby controlling the flood electrons to provide a more uniform flood electron beam to minimize landing angle of the flood electrons onto or through storage target means.

14 Claims, 3 Drawing Figures

CHARGE IMAGE CHARGE TRANSFER CATHODE RAY TUBE HAVING A SCAN EXPANSION ELECTRON LENS SYSTEM AND COLLIMATION ELECTRODE MEANS

BACKGROUND OF THE INVENTION

U.S. Pat. No. 3,710,173 to Hutchins et al, U.S. Pat. No. 3,710,179 to Hayes et al and U.S. Pat. No. 3,753,129 to Janko disclose a charge image charge transfer cathode ray tube which includes a conventional electron lens system and collimation electrode means. The conventional electron lens system of these charge image charge transfer cathode ray tubes does not provide adequate sensitivity in the vertical deflection means as well as scan expansion of the writing electron beam and the spot size is larger which results in a slower writing beam of less bandwidth. The conventional collimation electrode mans of these charge image charge transfer cathode ray tubes does not permit the flood beam electrons to impinge on and/or pass through the storage target means at substantially a normal direction thereto during the writing mode or the erase mode thereby not providing full scan performance. Moreover, conventional schemes for significant expansion of the beam scan involve acceleration of the electron beam to a high velocity immediately after focus and deflection by the post deflection acceleration system which is generally not used in storage cathode ray tubes.

SUMMARY OF THE INVENTION

The present invention relates to improvements in cathode ray tubes and more particularly to charge image charge transfer cathode ray tubes employing electrostatic deflection for deflection amplification of the writing electron beam and collimating electrode means for controlling the flood electron beam in engagement with and passage through transmission target means.

In accordance with the present invention, a cathode ray tube is provided with adjacent quadrupole lens for focusing the electron beam prior to the beam passing into the vertical deflection plates. The electron beam after being vertically deflected in the vertical deflection plates passes into another quadrupole lens which continues to focus the vertically-deflected beam and enhances the angle of deflection as the electron beam then passes between the horizontal deflection plates which horizontally deflects the electron beam. The electron beam without being further accelerated then impinges onto a fast-writing target means, and depending on voltages applied to adjacent target means, the cathode ray tube can operate in several modes of operation including bistable, halftone, bistable transfer and halftone transfer. Collimation electrode means having a specific configuration and disposed on an inner surface of the cathode ray tube envelope cause flood electrons to engage and/or pass through the target means at a substantially normal direction thereto.

An object of the present invention is to provide a charge image charge transfer cathode ray tube having an electron lens system to provide greater sensitivity and scan expansion of the electron beam in the vertical deflection means thereby resulting in smaller spot size and higher beam current per trace wdith.

Another object of the present invention is the provision of a charge image charge transfer cathode ray tube having collimation electrode means of a specific configuration that causes flood electrons from flood gun means to land on and/or pass through target means at a substantially normal direction thereto which results in more uniformity of the flood electron beam and improved full scan performance.

A further object of the present invention is to provide quadrupole lens means and collimating electrode means for use in a charge image charge transfer cathode ray tube for providing sensitivity in the vertical deflection means and expanding the scan of an electron beam and causing the flood electron beam to impinge onto and/or pass through target means at a substantially normal direction thereto.

An additional object of the present invention is the provision of a charge image charge transfer cathode ray tube having quadrupole lens means positioned before the vertical deflection plates and quadrupole lens means positioned between the vertical deflection plates and the horizontal deflection plates.

Still another object of the present invention is to provide a charge image charge transfer cathode ray tube that provides significant improvements in the writing speed and control of the flood electrons and the bandwidth has been increased at least four times over existing charge image charge transfer cathode ray tubes.

The novel features which are believed to be characteristic of the invention together with further objects and advantages thereof will be better understood from the following description considered in connection with the accompanying drawings in which a preferred embodiment of the invention is illustrated by way of example. It is to be understood, however, that the drawings are for the purpose of illustration and description only and are not intended as a definition of the limits of the invention.

DETAILED DESCRIPTION OF THE INVENTION

Figure 1:
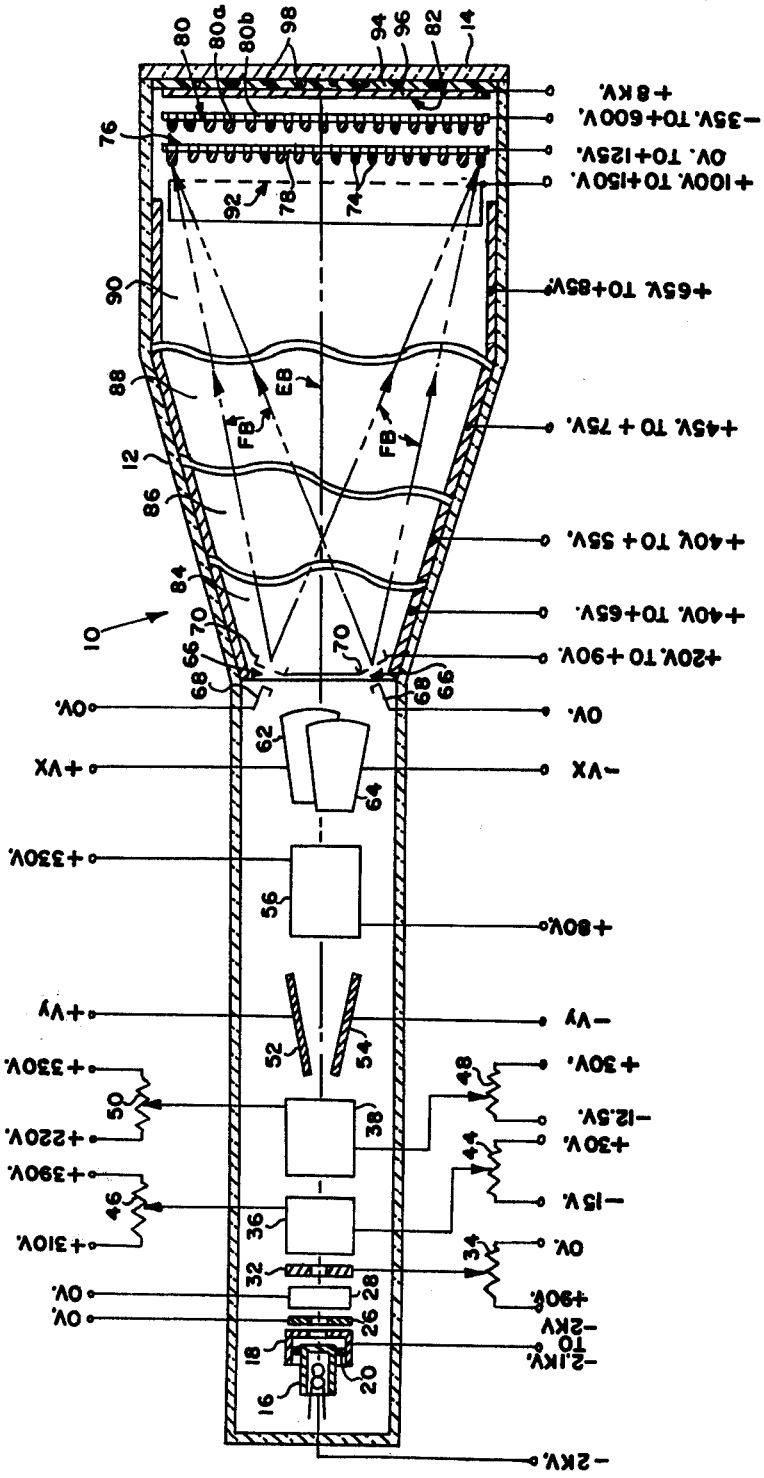
FIG. 1 is a schematic longitudinal sectional view of the improved charge image charge transfer cathode ray tube in accordance with the invention which is taken along the central vertical plane of the tube.

In reference to the drawings, a cathode ray tube 10 is provided with an envelope 12 the neck section of which is preferrably formed of glass in which the writing gun electron optics system are principally disposed and the funnel section of which is preferrably formed of ceramic having a frustrum of a cone configuration on which the flood collimation electron optics system principally diposed with a glass faceplate 14 frit sealed thereonto. The glass section and ceramic section are also frit sealed together. Such an envelope is disclosed in U.S. Pat. No. 3,207,936.

The electron optics system includes a heated cathode 6 that is connected to −2KV. for generating a high velocity writing electron beam EB. A grid electrode 18 is disposed adjacent to and has cathode 16 mounted therein via an insulating ceramic member 20. Grid 18 is connected to — 2.1 to −2KV. and it is connected to a cross-shaped plate 22 that is mounted to glass rods 24 and has an aperture 22a therethrough to enable the electron beam to pass thereoutof. Grid electrode 18 controls emission of the electron beam as it passes through the aperture. A tetrode electrode 26 is in the form of a cross-shaped plate and it has an aperture 26a therethrough to enable the electron beam to pass therethrough. It is normally connected to 0V. which accelerates the electron beam as it passes therethrough. An anode 28 is located adjacent tetrode electrode 26 which is connected to 0V., and it is mounted to glass rods 24 via cross-shaped plates 30. An inner end of anode 28 and the second plate 30 which is disposed downstream from first plate 30 have apertures 30a to permit the electron beam to enter and leave the anode. Anode 28 accelerates the electron beam as it enters therein.

Figures 2, 3:
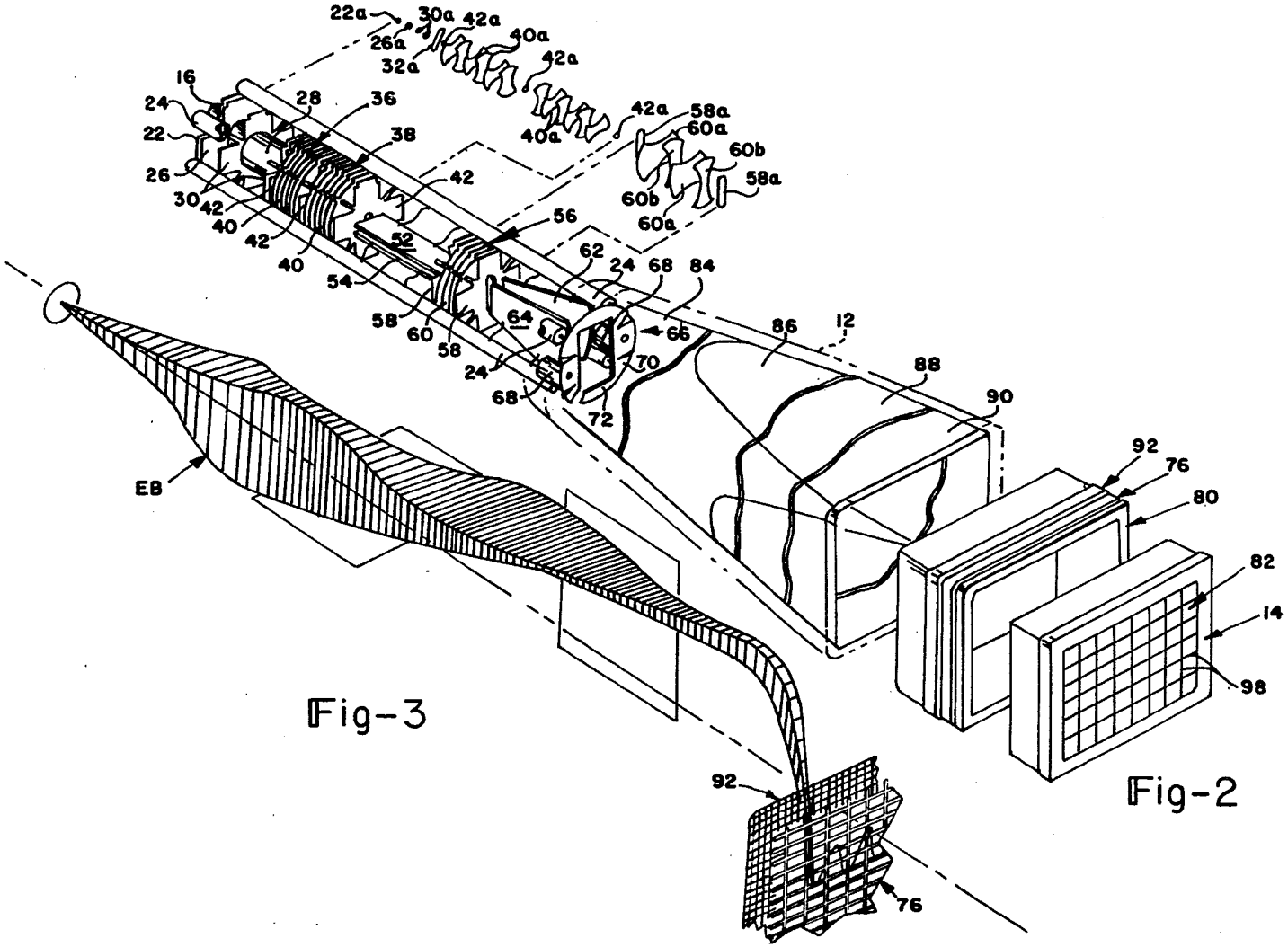
FIG. 2 is a perspective view of the electron optics system, collimating electrodes and screen means of the tube of FIG. 1 showing the aperture formations in the plates as exploded therefrom.
FIG. 3 is a perspective view of an electron beam envelope formed by the electron optics system of FIG. 2.

Stigmator lens 32 is a plate that is secured to glass rods 24 and it has an oblong aperture 32a (FIG. 2) therethrough which is tilted at about 45° relative to a vertical plane that passes through the tube axis. Stigmator lens 32 is connected to a movable contact of a potentiometer 34 which has one end connected to 0V. and the other end connected to +90V. Stigmator lens 32 corrects for beam astigmatism.

The focus lens is disposed adjacent to the stigmator lens 32 and include a first quadrupole lens 36 and a second quadrupole lens 38. Each of these quadrupole lens is formed from a series of substantially circular plates 40 which are disposed between cross-shaped plates 42 and these plates are secured in glass rods 24. Cross-shaped plates 42 have circular apertures 42a therethrough, whereas circular plates 40 have apertures 40a therethrough. Apertures 40a are of the same size and they have opposing inwardly-curved and opposing outwardly-curved surfaces. Alternate plates 40 are electrically connected together and apertures 40a therein are disposed in the same direction while the other alternate plates 40 are electrically connected together and apertures 40a therein are disposed in the same direction but at right angles to apertures 40a in the first alternate plates 40. One side of quadrupole lens 36 is connected to a movable contact of potentiometer 44 which has one end connected to −15V. and the other end is connected to +30V. The other side of lens 36 is connected to a movable contact of potentiometer 46 which has one end connected to −310V. and the other end is connected to +390V. One side of quadrupole lens 38 is connected to a movable contact of potentiometer 48 which has one end connected to −12.5V. and the other end is connected to +30V. The other side of lens 38 is connected to a movable contact of potentiometer 50 which has one end connected to +220V. and the other end is connected to +330V. Quadrupole lens 36 converges the electron beam in the X-Z plane and diverges it in the Y-Z plane whereas quadrupole lens 38 diverges the electron beam in the X-Z plane and converges it in the Y-Z plane.

Vertical deflection plates 52 and 54 are positioned on opposite sides of the tube axis and they are secured to glass rods 24 to maintain them in position. Vertical deflection plate 52 is connected to $+V_Y$ and vertical deflection plate 54 is connected to $-V_Y$ so that an input signal connected thereto will be applied to these plates and deflect the electron beam in accordance thereto as the electron beam passes therealong. A vertical deflection structure as taught in U.S. Pat. No. Re 28,223 can also be used in place of plates 52 and 54 if desired.

Third quadrupole lens 56 is formed from cross-shaped plates 58 with substantially circular plates 60 therebetween. Plates 58 have oblong openings 58a therethrough which extend in the same direction as a vertical plane containing the tube axis. The first and third plates 60 are electrically connected together and they have openings 60a therethrough which have opposing inwardly-curved surfaces and outwardlycurved surfaces. The second and fourth plates 60 are electrically connected together and they have openings 60b therethrough which also have inwardly-curved opposing surfaces and outwardly-curved opposing surfaces. Openings 60a are disposed at right angles with respect to openings 60b, and openings 60a can be larger in size than openings 60b. One side of lens 56 is connected to 80V. and the other side is connected to +330V. This third quadrupole lens 56 constitutes a scan expansion lens which converges the electron beam in the X-Z plane and diverges it in the Y-Z plane. This lens 56 also enhances the angle of deflection of the electron beam which has been applied thereto via vertical deflection plates 52 and 54.

As pointed out above, the quadrupole lenses 36, 38 and 56 are preferably formed from cross-shaped and circular plate members having specific openings therethrough; however, these quadrupole lenses can be made hyperbolically-shaped electrodes in accordance with the quadrupole lens disclosed in U.S. Pat. Nos. 3,496,406 and 3,792,303.

Horizontal deflection plates 62 and 64 are positioned on each side of the tube axis and they are maintained in position by being mounted to glass rods 24. These horizontal deflection plates 62 and 64 are connected respectively to $+V_X$ and $-V_X$ which are connected to conventional sweep circuitry to sweep the electron beam in one mode of operation across the target 76 which is disposed adjacent the inside surfae of faceplate 14 in order to form a charge image on storage dielectric layer 74 of first storage target 76. The structure from cathode 16 to horizontal deflections plates 62 and 64 define a writing gun. The present CRT can also operate in full scan or reduced scan modes of operation as desired which are conventional modes of operation.

A flood gun structure 66 is secured to glass rods 24 adjacent horizontal deflection plates 62 and 64 and it provides a pair of flood guns each of which includes a cathode 68 and an anode 70. Cathodes 68 are connected to 0V. and anode 70 is in the form of a plate carrying cathodes 68 and it has a rectangular opening 72 to permit passage of electron beam EB therethrough. Anode 70 is connected to +20V. to +90V. The flood guns of flood gun structure 66 emit low velocity flood electrons from the cathodes 68 which are transmitted as two wide angle flood beams FB which in one mode of operation bombard storage dielectric layer 74 of first transmission storage target 76 in a substantially uniform manner and at a substantially normal direction thereto.

Storage dielectric layer 74 of first transmission storage target 76 is provided on the left side of a first mesh target electrode 78 facing the writing gun in such a manner that the mesh apertures are left open. In order that this first target 76 has an extremely fast writing speed, the storage dielectric layer 74 is preferably made of highly porous insulating material such as for example magnesium oxide having a density of about 5 percent or less of its maximum bulk density and having a thickness on the order of 20 to 30 microns. The target electrode 78 may be an electroformed nickel mesh of about 250 lines per inch. This first transmission storage target 76 is disclosed in U.S. Pat. No. 3,710,173. A potential of 0V. to +125V. is applied to storage target 76.

Some of the flood electrons are transmitted through first target 76 to second transmission mesh storage target 80 and to the viewing target 82 in order to transfer the charge image from first target 76 to second target 80 to produce a light image on viewing target 82 corresponding to such charge image on first target 76 in the manner hereinafter described. Storage target 80 has applied thereto −35V. to +600V.

The low velocity flood electrons of flood beam FB are transmitted in the space surrounded by a collimating electrode system which comprises first, second, third and fourth collimating electrodes 84, 86, 88 and 90 respectively which are preferably in the form of wall bands of gold or other suitable conducting material that has been coated on the inner surface of the funnel section of envelope 12 and insulatingly spaced from each other by spaces of specific configuration. A collector electrode mesh 92 is disposed between collimating electrode 90 and first transmission storage target 76, and it has applied thereto +100V. to +150V.

The collimating electrodes have DC potentials applied thereto as follows:

Collimating electrode 84 . . . +40V. to +65V.
Collimating electrode 86 . . . +40V. to +55V.
Collimating electrode 88 . . . +45V. to +75V.
Collimating electrode 90 . . . +65V. to +85V.

The configurations of collimating electrodes 84, 86 88 and 90 will be determined by mapping on the inside surface of the funnel section the particular solution of Fourier-Bessel series functions in accordance with the general formula $$V(r,z) = V_i + \Sigma\, C\, I_o(r)\, \mathrm{Sin}(z)$$

wherein $V(r,z)$ is the potential at any location of the collimation space;

$V_1$ is the potential due to the initial conditions at the flood gun anodes and the collector electrode;

C is a constant; and $I_o(r)$ is a Bessel function at any radial location.

This information is disclosed in an article titled Hybrid Computer Aided Design of Thick Electrostatic Electron Lenses by J. Robert Ashley, pages 115–119 of the Proceedings of the IEEE, Vol. 60, No. 1, January 1972.

These collimating electrode configurations are determined by the potential due to the initial conditions at the flood gun anodes and the collector electrode, the flood guns being located away from the CRT axis, the configuration of the targets, the configuration of the funnel section and these unique collimating electrode configurations with the voltages being applied thereto provide effective control over the flood gun electrons so that they are uniformly distributed over the storage target and they engage or pass through the target at substantially a normal direction thereto. Thus, uniform flood electron density over the fast-writing target 76 and the engagement of these flood electrons onto target 76 or passage therethrough, as the case may be, as close to being perpendicular as possible are accomplished by the configuration of the collimating electrodes 84, 86, 88 and 90.

Collector electrode 92 is positioned in fron of first target 76 and collects secondary electrons emitted by storage dielectric 74 of first target 76.

Second target 80 is capable of longer storage time but is of slower writing speed than first target 76. Any suitable secondary emissive insulating material capable of bistable storage of a charge image for an indefinite time may be employed as a storage dielectric layer **80*a* on the left side of electro-formed nickel mesh target electrode 80*b*. For example, it has been found that a thin, dense layer of magnesium oxide formed on the mesh in accordance with the teaching set forth in U.S. Pat. No. 3,798,477 to Soltys will provide the storage dielectric layer 80*a***.

Thus, while the first storage dielectric 74 and the second storage dielectric **80*a* are both made of magnesium oxide, the first dielectric is of much lower density and greater thickness so that the first target has lower capacitance and, therefore, a faster writing speed than the second target. However, the second storage target 80** has a much longer storage time than the first storage target and is also capable of providing bistable storage while the first storage target is operated as a halftone storage target for maximum writing speed.

Viewing target 82 is composed of a layer of phosphor material 94 coated on the inner surface of faceplate 14 and an acceleration electrode 96 which is a layer of aluminum or other conductive material coated over the surface of the phosphor layer which is connected to +8KV. Thus, the space between second target 80 and viewing screen 82 constitutes an acceleration area for accelerating the flood electrons that pass through targets 76 and 80 so that they can impinge onto viewing screen 82 with sufficient velocity to cause phosphorescence to take place and provide a bright display of the information written on the targets 76 and 80.

The charge image charge transfer CRT of the present invention has four storage modes of operation each of which is determined by the voltages that are applied onto collimating electrodes 84, 86, 88 and 92, collector electrode 92, and targets 76 and 80.

In the halftone mode of operation, the writing electron beam writes information as a charge image on low speed target 80 after it has been prepared for halftone operation. Flood electrons from the flood beam pass through the mesh openings on target 76 through the openings in target 80 where the charge image is located and these flood electrons are accelerated onto viewing target screen 82 causing the phosphor layer 94 to reproduce the charge image on the target 80 as a lighted image for viewing or recording purposes. An illuminated graticule scale 98 can be provided on the faceplate 14 in accordance with the teaching of U.S. Pat. No. 3,683,225 to Butler and U.S. Patent Application Ser. No. 743,017 filed Nov. 18, 1976.

The bistable mode of operation requires that the low speed target 80 be prepared for bistable operation before the writing electron beam writes information thereon. After the writing beam has written information onto the low speed target in the form of a charge image, flood electrons from the flood beam then cause the information stored on bistable target 80 to be displayed on viewing target as described above relative to the halftone mode of operation.

In the halftone transfer mode of operation, low speed target 80 is prepared for halftone operation after which high speed target 76 is prepared for such operation. The writing beam writes information on the high speed target 76 in the form of a charge image whereafter this information is transferred from the high speed target 76 to low speed target 80 by flood electrons passing through high speed target 76 and impinging on low speed target 80. The flood electrons engaging low speed target 80 write this transferred information thereonto by secondary emission. The transferred information is displayed on viewing target 82 by the flood electrons passing through targets 76 and 80 in the same manner as described above in relation to the halftone mode of operation.

The bistable transfer mode of operation is the same as the halftone transfer mode of operation except that the low speed target 80 is prepared for bistable operation.

The required voltages for operating the charge image charge transfer cathode ray tube in any of the above or other modes of operation are applied to the flood gun anodes 70, collimating electrodes 84, 86, 88 and 90, collector electrode 92, high speed target 76 and low speed target 80 by conventional pulse generator circuit means that are constructed of conventional oscillator and pulse shaper electronic circuits which need not be described in detail as they form no pertinent part of the cathode ray tube construction. The operation of charge image charge transfer cathode ray tubes is well known, and, for a complete disclosure of such operation, reference is made to U.S. Pat. Nos. 3,710,173; 3,710,179 and 3,753,129.

The present CRT has a normal mode of operation whereby the writing beam passes through the collector electrode 92, storage targets 76 and 80 and onto viewing target 82 which displays the signal information in a conventional manner.

The present charge image charge transfer CRT provides significant writing speed improvement over existing charge image charge transfer CRT's as a result of an improved electron gun structure and improved collimating electrode configuration. The improved electron gun structure includes quadrupole focusing lens means before the deflection means and quadrupole focusing lens means between the vertical and horizontal deflection means. This structure provides a high speed writing electron beam having a smaller spot size, higher beam current per trace width and very good spot uniformity over the target area. The scan expansion provided by this unique electron gun structure provides higher beam velocity because of higher gun velocity and reduces the magnification ratio for the smaller spot size. The specific collimating electrode configuration provides uniformity of flood electrons over the target means and impingement of the flood electrons onto the target means or passage therethrough is as closer to a normal direction thereto than has heretofore been attained. These improved structures has enabled the bandwidth of the CRT to be increased at least four times over existing CRT's of similar construction.

It will be obvious to those having ordinary skill in the art that changes may be made in the details of the above-described invention. For example, the present invention may be employed in conjunction with single target transmission storage cathode ray tubes in order to improve the operation thereof or in a bistable faceplate storage tube of the type disclosed in U.S. Pat. No. 3,293,473 to Anderson. Therefore, the scope of the present invention should only be determined by the following claims.

The invention is claimed in accordance with the following:

1. A charge image charge transfer cathode ray tube, comprising:

an envelope having a fluorescent screen at one end and cathode means at another end for producing a writing electron beam of high velocity electrons directed toward said screen;

deflection means disposed along a tube axis of said envelope and including elements for deflecting said electron beam in mutually perpendicular directions;

first quadrupole lens means disposed along said tube axis and positioned before said deflection means for focusing said electron beam in mutually perpendicular directions and second quadrupole lens means disposed along said tube axis and positioned between said elements of said deflection means for amplifying the electron beam deflection while maintaining the electon beam velocity constant;

transmission mesh storage target means disposed adjacent said fluorescent screen including mesh target electrode means and storage dielectric means provided on said mesh target electrode means leaving open the mesh apertures, said writing beam adapted to bombard said storage dielectric means at voltages at which the secondary emission ratio of the dielectric means is greater than unity to write a charge image on said dielectric means;

flood gun means adjacent said deflection means for providing a flood gun beam of low velocity flood electrons over said target means;

collector electrode means disposed adjacent said target means for collecting secondary electrons emitted by said storage dielectric means; and collimating electrode means provided along said envelope between said flood gun means and said collector electrode means thereby causing the flood electrons to be distributed uniformly over said target means and to engage said target means or pass through apertures thereof at a substantially normal direction thereto.

2. A charge image charge transfer cathode ray tube according to claim 1 wheren said transmission mesh storage target means comprises a first mesh target electrode means having first storage dielectric means thereon defining a high speed target means and a second mesh target electrode means having secnd storage dielectric means thereon defining a low speed target means.

3. A charge image charge transfer cathode ray tube according to claim 1 wherein said first storage dielectric means is a low density material which is less than about 5 percent of its bulk density.

4. A charge image charge transfer cathode ray tube according to claim 1 wherein said second storage dielectric means has a greater capacitance than said first storage dielectric means.

5. A charge image charge transfer cathode ray tube according to claim 1 wherein the thickness of said first storage dielectric means is greater than that of said second storage dielectric means.

6. A charge image charge transfer cathode ray tube according to claim 1 wherein said quadrupole lens means comprises spaced plate means having apertures of specific configurations therethrough to provide quadrupolar fields for controlling said electron beam as it passes therethrough.

7. A charge image charge transfer cathode ray tube according to claim 1 wherein said collimating electrode means have a predetermined configuration and each collimating electrode means has a range of voltage connected thereto depending on the mode of operation thereof.

8. A charge image transfer cathode ray tube, comprising:

transmission storage target means including mesh electrode means having mesh openings therethrough and storage dielectric means provided on said mesh electrode means without covering said mesh openings;

flood gun means for generating toward said transmission storage target means flood electron beams of low velocity electrons;

electron gun means including cathode means for generating an electron beam of high velocity electrons, focusing means defining quadrupole lens means for focusing said electron beam into a writing beam and deflection means including elements for deflecting said writing beam along said storage dielectric means in mutually perpendicular directions thereby forming a positive charge image thereon, said quadrupole lens means including first quadrupole lens means positioned between said electron gun means and said deflection means for focusing said electron beam in mutually perpendicular directions and second quadrupole lens means positioned between said elements of said deflection means for amplifying the electron beam deflection while maintaining the electron beam velocity constant; and collimating electrode means provided between said flood gun means and said transmission storage target means to cause said flood electrons to uniformly bombard said storage dielectric means at a substantially normal direction thereto and to enable said flood electrons to be transmitted through said mesh openings adjacent said charge image at a substantially normal direction thereto.

9. A charge image charge transfer cathode ray tube according to claim 8 which includes viewing target means positioned on the opposite side of said transmission storage target means from said cathode means so that said flood electrons that are transmitted through the mesh openings adjacent said charge image engage said viewing target means and form a light image thereon corresponding to said charge image.

10. A charge image charge transfer cathode ray tube according to claim 8 wherein collector electrode means is positioned in front of said transmission storage target means.

11. A charge image charge transfer cathode ray tube according to claim 8 wherein said transmission storage target means includes high speed target means and low speed target means each of which has mesh electrode means provided with mesh openings therethrough and storage dielectric means provided on said mesh electrode means without covering said mesh openings.

12. A charge image charge transfer cathode ray tube according to claim 11 wherein said storage dielectric means on said high speed target means is of less density than said storage dielectric means on said low speed target means.

13. A charge image charge transfer cathode ray tube according to claim 11 wherein the thickness of said storage dielectric means on said high speed target means is greater than that of said storage dielectric means on said low speed target means.

14. A charge image charge transfer cathode ray tube according to claim 8 wherein said collimating electrode means have predetermined configurations and voltages applied thereto.

* * * * *

UNITED STATES PATENT AND TRADEMARK OFFICE

CERTIFICATE OF CORRECTION

PATENT NO. : 4,130,775

DATED : December 19, 1978

INVENTOR(S) : PETER E. PERKINS and STEPHEN F. BLAZO

It is certified that error appears in the above-identified patent and that said Letters Patent are hereby corrected as shown below:

Column 1, Line 65 change "wdith" to --width--.
Column 1, Line 19 change "mans" to --means--.
Column 2, Line 65 change "6" to --16--.
Column 3, Line 47 change "-310V" to --+310V--.
Column 4, Line 37 change "surfae" to --surface--.
Column 5, Line 31 change "86" to --86,--.
Column 5, Line 42 change "$V_1$" to --$V_i$--.
Column 6, Line 1 change "fron" to --front--.
Column 7, Line 52 change "is" to --in--.
Column 7, Line 54 change "has" to --have--.
Column 8, Line 18 change "electon" to --electron--.
Column 8, Line 42 change "wheren" to --wherein--.
Column 8, Line 46 change "secnd" to --second--.

Signed and Sealed this

*Third* Day of *July 1979*

[SEAL]

*Attest:*

*Attesting Officer*

LUTRELLE F. PARKER

*Acting Commissioner of Patents and Trademarks*